US010355400B2

(12) United States Patent
Yokoyama et al.

(10) Patent No.: US 10,355,400 B2
(45) Date of Patent: Jul. 16, 2019

(54) CONNECTOR DEVICE

(71) Applicant: Yazaki Corporation, Tokyo (JP)

(72) Inventors: Haruhiko Yokoyama, Shizuoka (JP); Hajime Kato, Shizuoka (JP); Takaaki Miyajima, Shizuoka (JP); Satoshi Nakai, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/985,508

(22) Filed: May 21, 2018

(65) Prior Publication Data

US 2018/0342833 A1 Nov. 29, 2018

(30) Foreign Application Priority Data

May 25, 2017 (JP) ..... 2017-103591

(51) Int. Cl.

| | |
|---|---|
| ***H01R 4/34*** | (2006.01) |
| ***H01R 4/70*** | (2006.01) |
| ***H01R 11/12*** | (2006.01) |
| ***H01R 13/11*** | (2006.01) |
| ***H01R 13/42*** | (2006.01) |
| ***H01R 13/53*** | (2006.01) |
| ***H01R 13/58*** | (2006.01) |
| ***H01R 13/62*** | (2006.01) |
| ***H01R 24/28*** | (2011.01) |

(Continued)

(52) U.S. Cl.

CPC ..... *H01R 13/5825* (2013.01); *H01R 4/70* (2013.01); *H01R 13/42* (2013.01); *H01R 13/502* (2013.01); *H01R 13/53* (2013.01); *H01R 13/62* (2013.01); *H01R 4/34* (2013.01); *H01R 11/12* (2013.01); *H01R 13/11* (2013.01); *H01R 24/28* (2013.01); *H01R 2105/00* (2013.01)

(58) Field of Classification Search

USPC ..... 439/188, 694

See application file for complete search history.

(56) References Cited

U.S. PATENT DOCUMENTS 5,788,520 A * 8/1998 Roche ..... H01R 13/7032 200/51.1

5,997,344 A * 12/1999 Shinozaki ..... H01R 13/5213 439/188

(Continued)

FOREIGN PATENT DOCUMENTS

JP 2014-086349 A 5/2014

*Primary Examiner* — Gary F Paumen

(74) *Attorney, Agent, or Firm* — Kenealy Vaidya LLP

(57) ABSTRACT

The connector device includes a first connector in which a first conductive member is housed in a first housing chamber, a second connector including a second housing chamber, and a cover, wherein the second housing chamber has a first housed position of the holding member of when an energization circuit is in an energized state, and a second housed position of the holding member of when the energization circuit is in a broken state, the holding member includes a non-contact portion that does not come into contact with a protruded body of the cover in a case of the first attachment state, and a pushed portion pushed by the protruded body to the second housed position in a case of the first housed position and in a case where the cover is attached in the second attachment state to the second opening.

8 Claims, 11 Drawing Sheets

(51) Int. Cl.
*H01R 105/00* (2006.01)
*H01R 13/502* (2006.01)

(56) References Cited

U.S. PATENT DOCUMENTS

| | | | | |
|---|---|---|---|---|
| 8,956,186 | B2 * | 2/2015 | de Chazal | H01R 13/652 439/607.27 |
| 9,312,626 | B2 * | 4/2016 | Itsuki | H01R 13/5208 |
| 9,368,902 | B2 * | 6/2016 | Nakai | H01R 13/5202 |
| 9,472,893 | B1 * | 10/2016 | Motohashi | H01R 13/533 |
| 9,653,843 | B2 * | 5/2017 | Suzuki | H01R 13/5221 |
| 9,819,120 | B2 * | 11/2017 | Mukuno | H01R 13/533 |
| 2013/0303006 | A1 * | 11/2013 | Casses | H01R 13/7032 439/135 |
| 2014/0120763 | A1 | 5/2014 | Itsuki et al. | |
| 2014/0148026 | A1 * | 5/2014 | Nomura | H01R 13/703 439/188 |
| 2015/0140846 | A1 * | 5/2015 | Kanemura | H01R 13/7032 439/188 |
| 2015/0229080 | A1 * | 8/2015 | Degen | H01R 24/22 439/43 |
| 2016/0156120 | A1 * | 6/2016 | Ciampolini | H01H 27/08 439/134 |

* cited by examiner

CONNECTOR DEVICE

CROSS-REFERENCE TO RELATED APPLICATION(S)

The present application claims priority to and incorporates by reference the entire contents of Japanese Patent Application No. 2017-103591 filed in Japan on May 25, 2017.

BACKGROUND OF THE INVENTION

1. Field of the Invention

The present invention relates to a connector device.

2. Description of the Related Art

Conventionally, a connector device including a first connector and a second connector that can be fit to and separated from each other has been known. In the connector device, by fitting the first connector and the second connector to each other, it is possible to form an energization circuit associated with electrical connection therebetween. On the other hand, in this connector device, by separating the first connector and the second connector in a fit state from each other, it is possible to release the electrical connection therebetween and to break the energization circuit. This kind of connector device is disclosed, for example, in Japanese Patent Application Laid-open No. 2014-86349.

Incidentally, in a conventional connector device, it is necessary to separate a first connector and a second connector from each other in order to break an energization circuit. Thus, depending on a usage environment, it is necessary in this connector device to keep the first connector and the second connector separated from each other in consideration of various requirements, which are related to durability and safety, such as waterproofing, dust-proofing, and protection of an exposed conductive portion.

SUMMARY OF THE INVENTION

Thus, the present invention is to provide a connector device in which it is possible to connect and break an energization circuit without being conscious of durability and safety.

In order to achieve the above mentioned object, a connector device according to one aspect of the present invention includes a first connector that includes a first conductive member, and a first housing body including a first housing chamber in which the first conductive member is housed, and a first opening and a second opening that are arranged in a connector insertion/removal direction and that communicate with the first housing chamber; a second connector that includes a second conductive member inserted into the first housing chamber from the first opening and physically and electrically connected to the first conductive member, a holding member that holds the second conductive member, and a second housing body including a second housing chamber in which the holding member is housed; and a cover that includes a cover main body that blocks the second opening, and a protruded body that is protruded from the cover main body and is arranged in the first housing chamber when the cover main body blocks the second opening, wherein the second housing chamber has a first housed position of the holding member of when an energization circuit formed by the first conductive member and the second conductive member is in an energized state, and a second housed position of the holding member of when the energization circuit is in a broken state, the cover can be attached to the second opening in a first attachment state in which the second opening is blocked by the cover main body and the protruded body is arranged in the first housing chamber, or a second attachment state which is an attachment state different from the first attachment state and in which the second opening is blocked by the cover main body and the protruded body is arranged in the first housing chamber, and the holding member includes a non-contact portion that does not come into contact with the protruded body regardless of own housed position in the second housing chamber in a case where the cover is in the first attachment state, and a pushed portion pushed by the protruded body until the own housed position in the second housing chamber becomes the second housed position in a case where the own housed position in the second housing chamber is the first housed position and the cover is attached in the second attachment state to the second opening.

According to another aspect of the present invention, in the connector device, it is possible to configure that the holding member includes a connector fit portion that is inserted, along with the second conductive member, into the first housing chamber from the first opening, and the connector fit portion includes the non-contact portion and the pushed portion.

According to still another aspect of the present invention, in the connector device, it is possible to configure that the non-contact portion is a housing portion in which the protruded body is housed when the cover is in the first attachment state, or an insertion portion into which the protruded body is inserted when the cover is in the first attachment state.

According to still another aspect of the present invention, in the connector device, it is possible to configure that a combination of the first conductive member and the second conductive member is provided for each phase of an electric circuit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
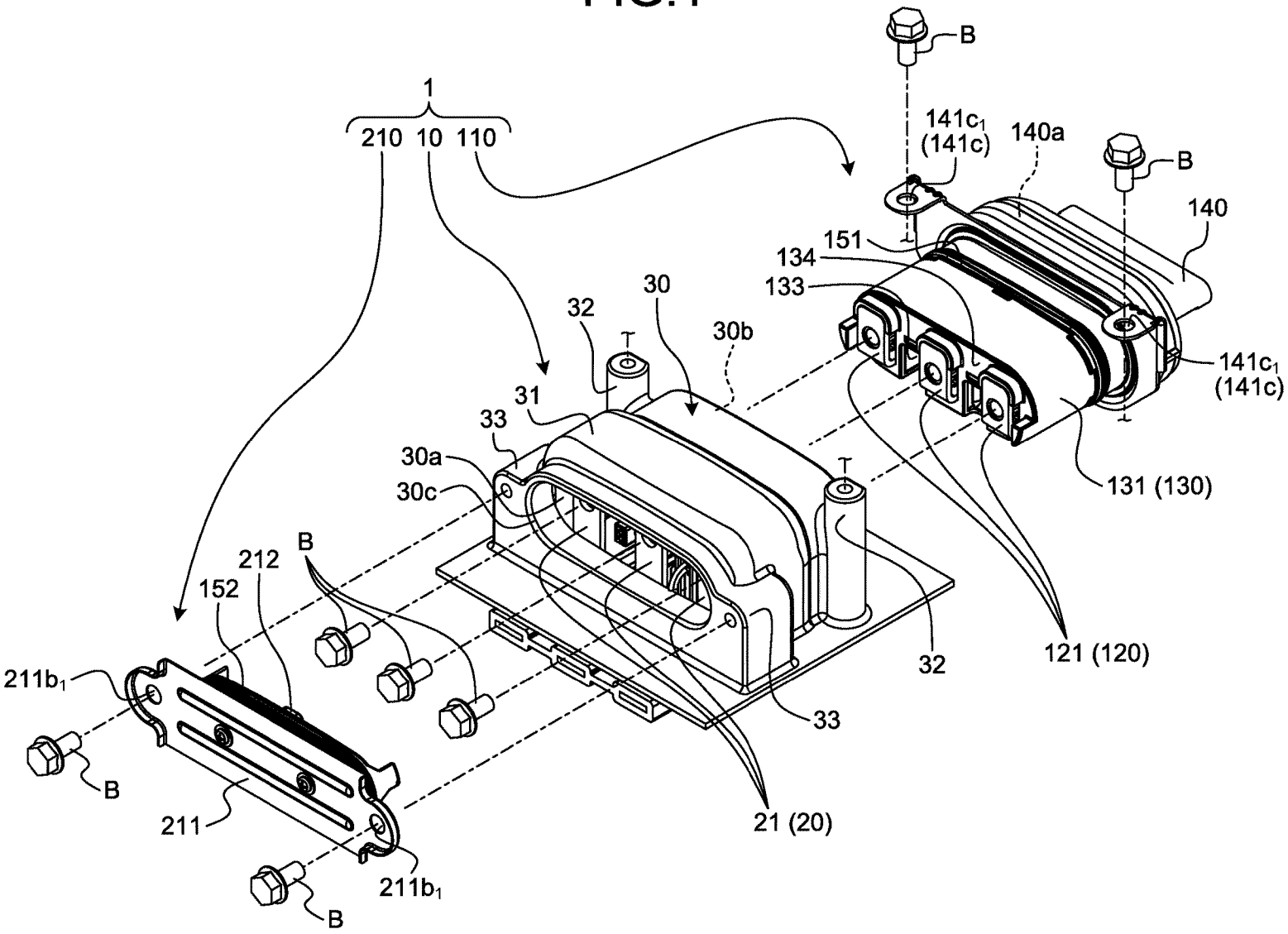
FIG. 1 is an exploded perspective view illustrating a connector device of an embodiment.
Figure 2:
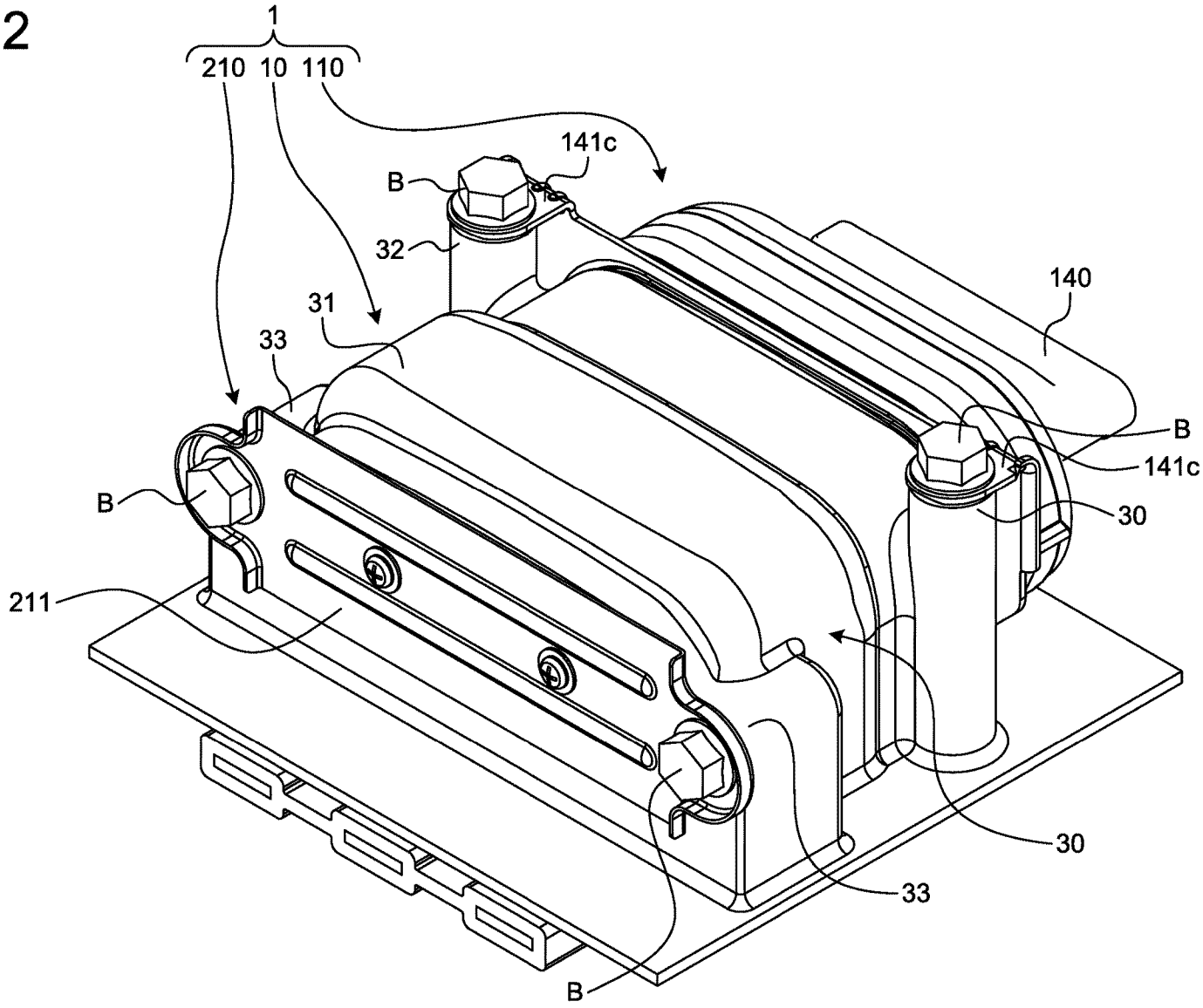
FIG. 2 is a perspective view illustrating the connector device of the embodiment.
Figure 3:
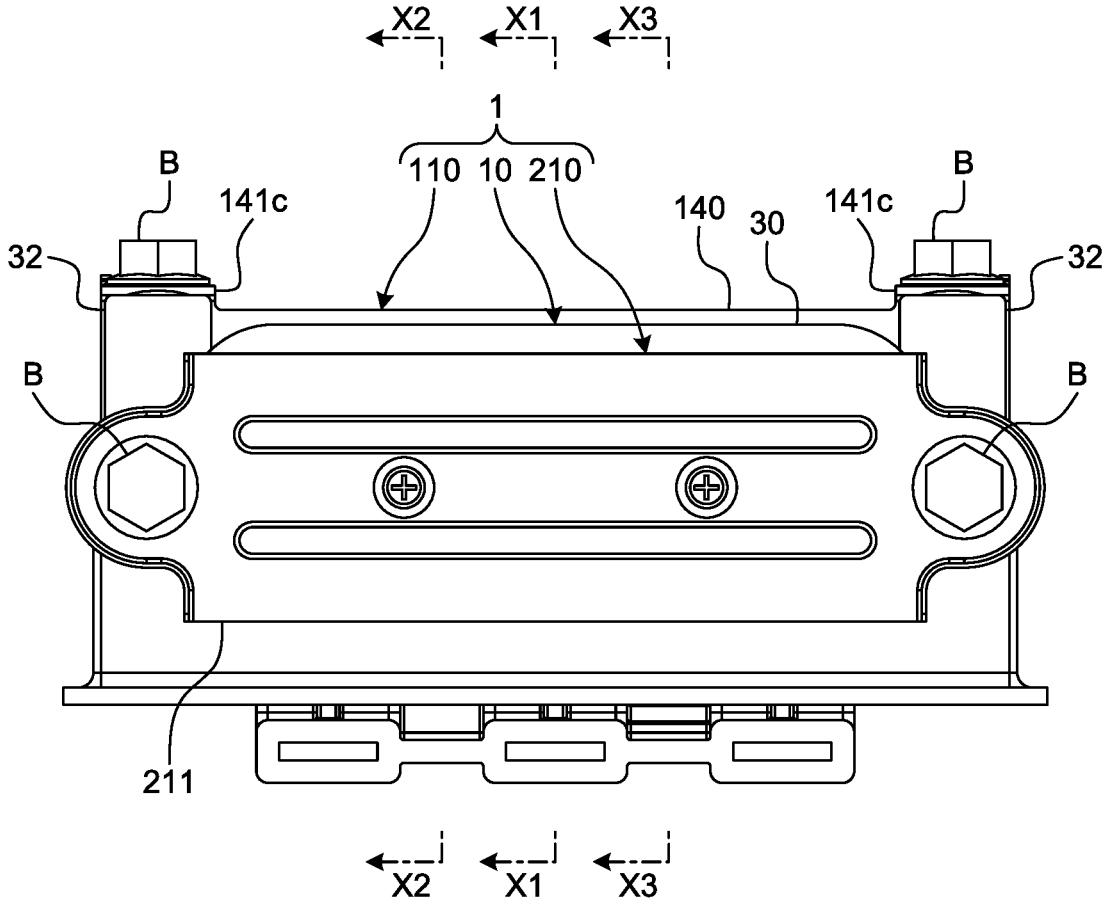
FIG. 3 is a plan view, in which the connector device of the embodiment is seen from a cover side, and is an expediential common view illustrating a first attachment state and a second attachment state of the cover.

In the following, an embodiment of a connector device according to the present invention will be described in detail on the basis of the drawings. Note that this invention is not limited to this embodiment.

Embodiment

One of embodiments of a connector device according to the present invention will be described on the basis of FIG. 1 to FIG. 12.

A reference sign 1 in FIG. 1 to FIG. 4 indicates a connector device of the present embodiment. The connector device 1 includes a first connector 10, a second connector 110, and a cover 210. The first connector 10 and the second connector 110 form an energization circuit by being inserted into and connected to each other, the energization circuit being broken by removal and separation thereof. In the following, a direction of inserting the second connector 110 into the first connector 10 is referred to as a "connector insertion direction," and a direction of removing the second connector 110 from the first connector 10 is referred to as a "connector removal direction." Also, in the following, a direction of insertion/removal between the first connector 10 and the second connector 110 is referred to as a "connector insertion/removal direction."

Figure 4:
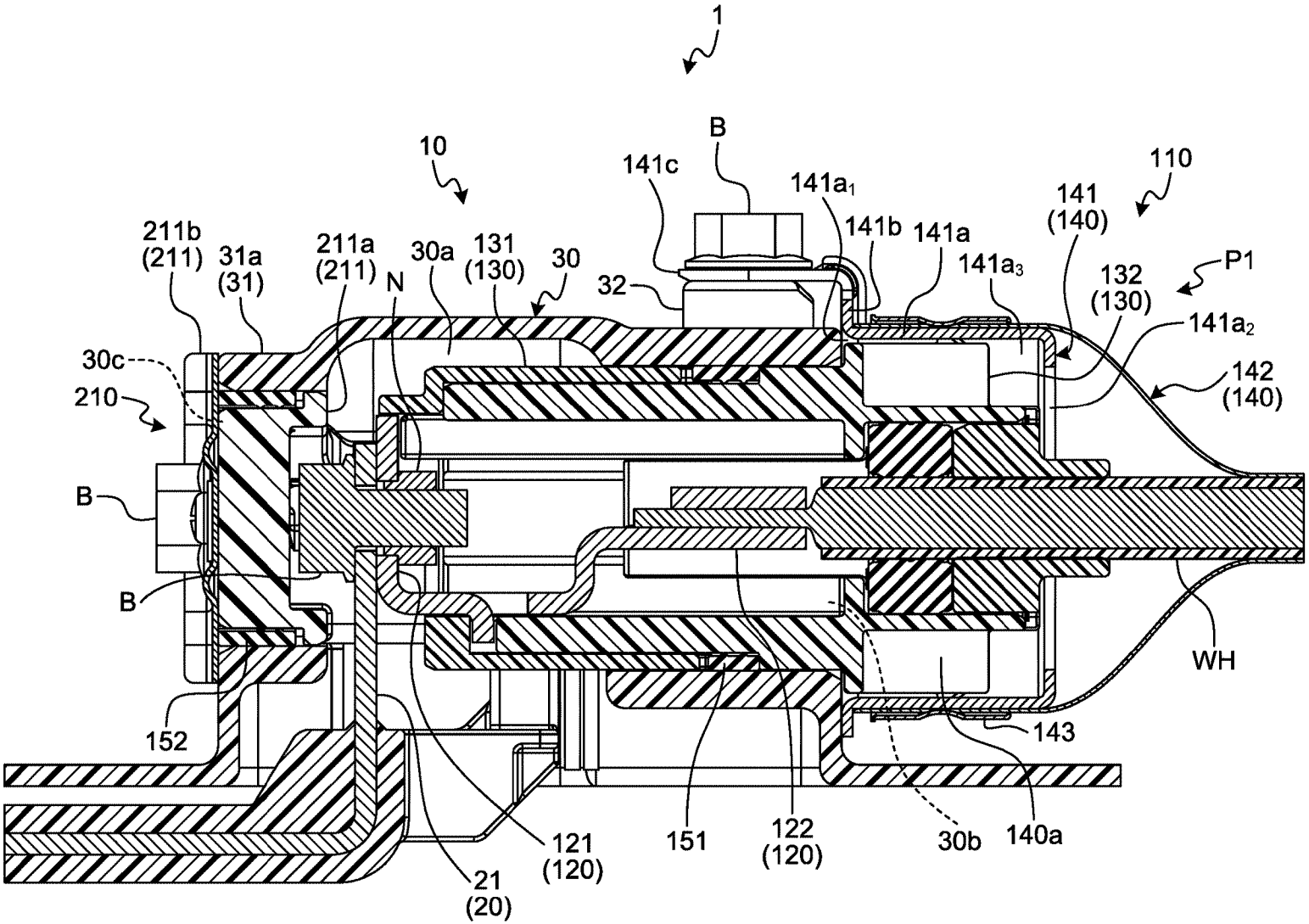
FIG. 4 is an X1-X1 sectional view of FIG. 3 and is a view illustrating a case where the cover is in the first attachment state.
Figure 5:
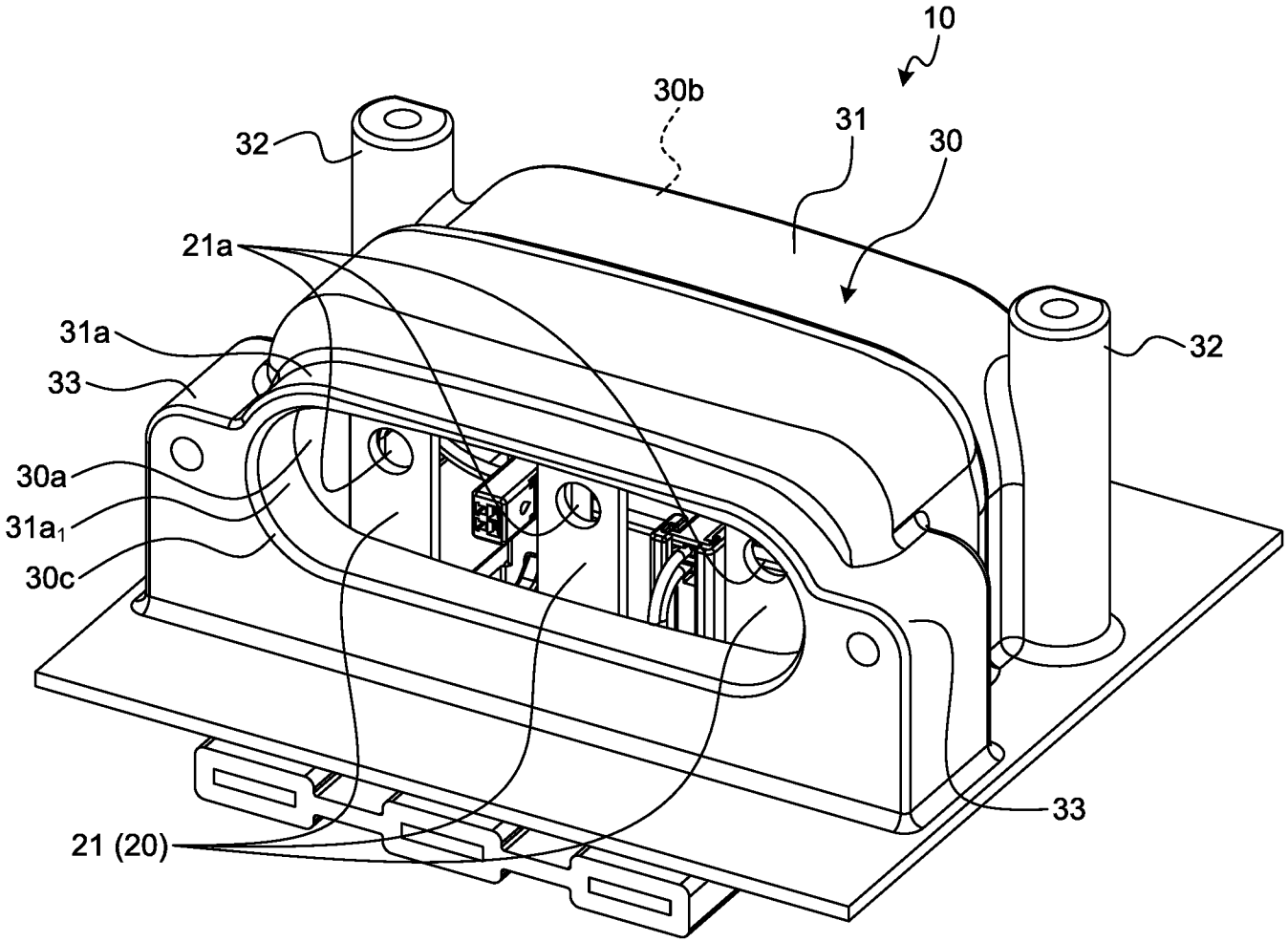
FIG. 5 is a perspective view illustrating a first connector.

The first connector 10 includes a first conductive member 20 and a first housing body 30 (FIG. 1, FIG. 4, and FIG. 5).

The first conductive member 20 includes an electric connection portion 21 that is physically and electrically connected to a counterpart conductive member (second conductive member 120 described later) (FIG. 1, FIG. 4, and FIG. 5). Also, this first conductive member 20 includes an electric wire connection portion (not illustrated) that is physically and electrically connected to an electric wire (not illustrated). This first conductive member 20 is formed of a conductive material such as metal. For example, the first conductive member 20 is formed by press working such as cutting or bending with a metallic plate as a base material. The first conductive member 20 in this example is formed as a plate-shaped bus bar.

In the electric connection portion 21, a through hole 21*a* with an axis being in a direction orthogonal to own plain surface is formed (FIG. 5). In the first connector 10, the first conductive member 20 is arranged with the orthogonal direction (axis direction of through hole 21*a*) being aligned with the connector insertion/removal direction.

The first housing body 30 is formed of an insulating material such as a synthetic resin. This first housing body 30 includes a first housing chamber 30*a* in which the first conductive member 20 is housed (FIG. 1, and FIG. 4 to FIG. 6). The first housing chamber 30*a* at least houses the electric connection portion 21 of the first conductive member 20. Also, the first housing body 30 has a first opening 30*b* and a second opening 30*c* that are arranged in the connector insertion/removal direction and that communicate with the first housing chamber 30*a*. In this first housing body 30, the first opening 30*b* is arranged on one side in the connector insertion/removal direction and the second opening 30*c* is arranged on the other side in the connector insertion/removal direction with the first housing chamber 30*a* as a boundary.

The first housing body 30 in this example includes a cylindrically-formed main body 31 with the connector insertion/removal direction as a cylinder axis direction (FIG. 1, FIG. 2, and FIG. 4 to FIG. 6). In this first housing body 30, an internal space of the cylindrical main body 31 is the first housing chamber 30*a*, and openings in the connector insertion/removal direction of this main body 31 are respectively the first opening 30*b* and the second opening 30*c*.

The second connector 110 includes a second conductive member 120, a holding member 130, and a second housing body 140 (FIG. 1, FIG. 4, FIG. 7, and FIG. 8).

The second conductive member 120 includes an electric connection portion 121 that is physically and electrically connected to a counterpart conductive member (first conductive member 20) (FIG. 1, FIG. 4, FIG. 7, and FIG. 8). In the connector device 1, the first conductive member 20 and the second conductive member 120 are electrically connected, whereby the first conductive member 20 and the second conductive member 120 from an energization circuit. Also, this second conductive member 120 includes an electric wire connection portion 122 that is physically and electrically connected to an electric wire WH (FIG. 4). This second conductive member 120 is formed of a conductive material such as metal. For example, the second conductive member 120 is formed by press working such as cutting or bending with a metallic plate as a base material. The second conductive member 120 in this example is formed as a plate-shaped bus bar.

Figure 7:
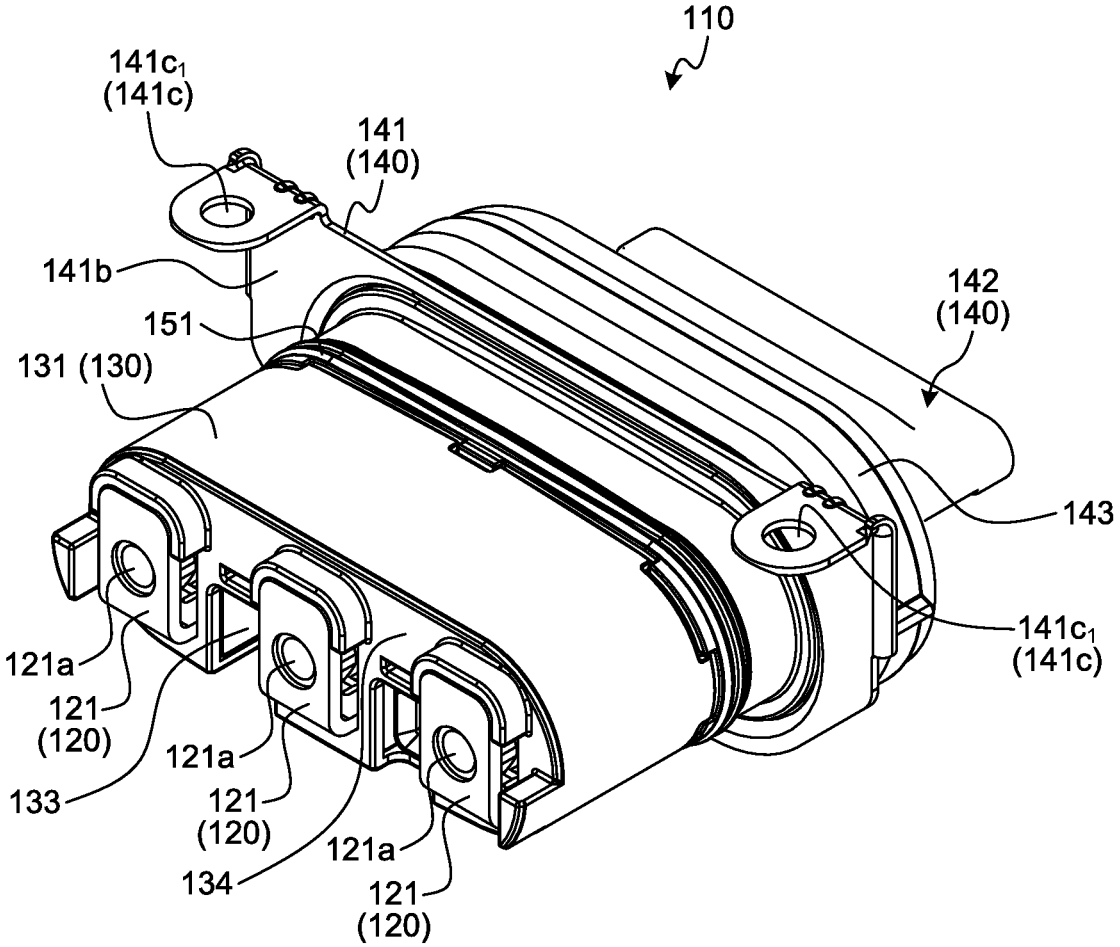
FIG. 7 is a perspective view illustrating a second connector.
Figure 8:
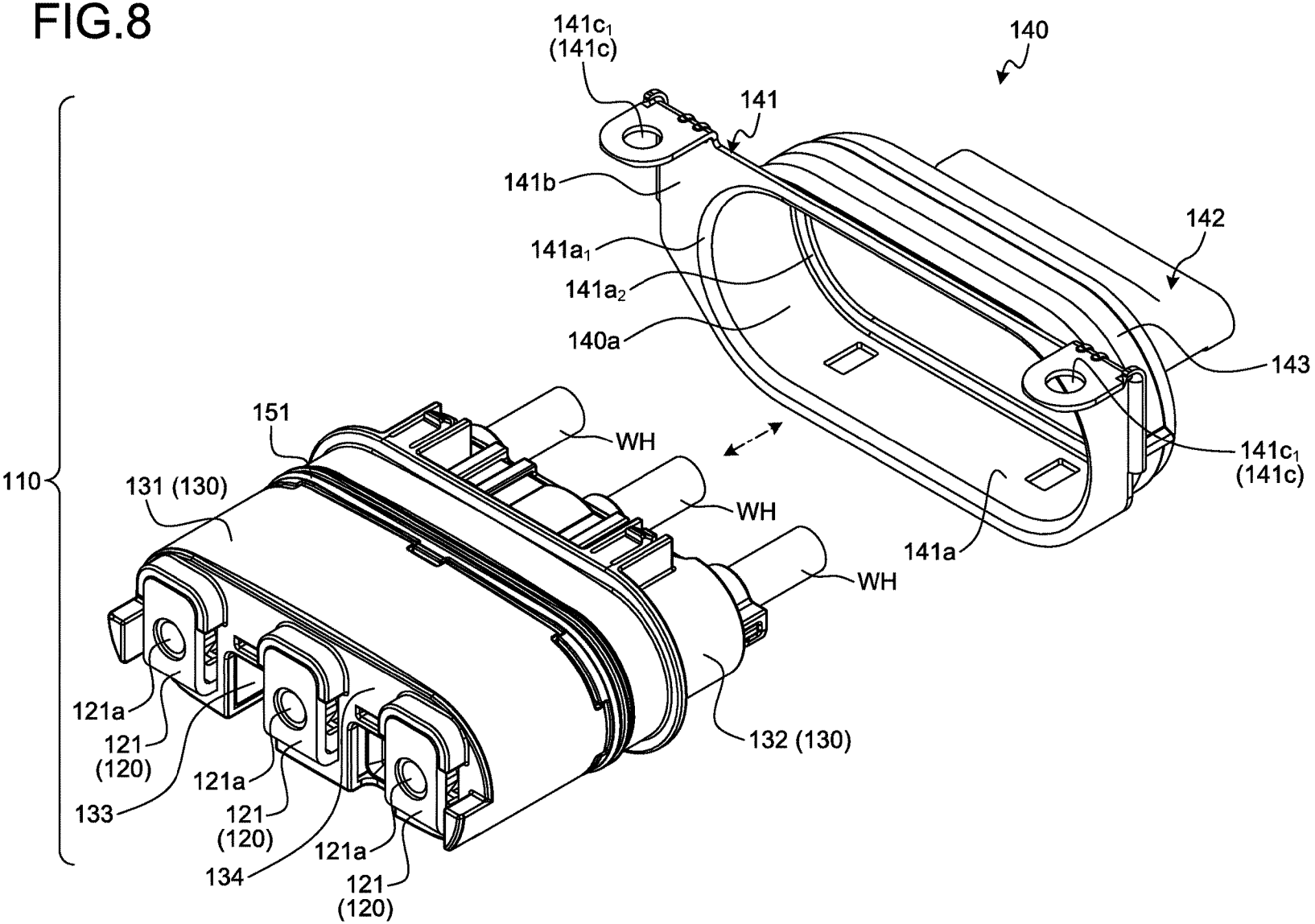
FIG. 8 is an exploded perspective view of the second connector.

In the electric connection portion 121, a through hole 121*a* with an axis being in a direction orthogonal to own plain surface is formed (FIG. 7 and FIG. 8). In the second connector 110, the second conductive member 120 is arranged with the orthogonal direction (axis direction of through hole 121*a*) being aligned with the connector insertion/removal direction.

In the second conductive member 120, the electric connection portion 121 is inserted from the first opening 30*b* into the first housing chamber 30*a* and is physically and electrically connected to the first conductive member 20 in the first housing chamber 30*a*. In this example, when the electric connection portion 121 is inserted into the first housing chamber 30*a*, the electric connection portions 21 and 121 are overlapped with each other in such a manner that the through holes 21*a* and 121*a* are overlapped with each other in the connector insertion/removal direction. The first conductive member 20 and the second conductive member 120 are electrically connected to each other by a contact between the electric connection portions 21 and 121. In this example, in order to keep the electrical connection state, male screw members B respectively inserted into the through holes 21*a* and 121*a* are screwed to female screw members N and the electric connection portions 21 and 121 are screwed and fixed (FIG. 4). A tool for screwing (not illustrated) is inserted from the second opening 30*c* and the screwing is performed. Here, a female screw member N is fixed by welding or the like to the electric connection portion 121 in a manner coaxial with the through hole 121*a*, and a male screw member B inserted from the second opening 30*c* is screwed to the female screw member N with the tool for screwing.

The holding member 130 is formed of an insulating material such as a synthetic resin, and holds the second conductive member 120. This holding member 130 includes one or a plurality of components. In this holding member 130, the second conductive member 120 is held in a state in which the electric connection portion 121 is exposed at an end on a side in the connector insertion direction. Also, in this holding member 130, the second conductive member 120 is held in a state in which a connection part between the electric wire connection portion 122 and the electric wire WH is housed inside. The electric wire WH is pulled out in the connector removal direction from this holding member 130.

This holding member 130 includes a connector fit portion 131 inserted, along with the second conductive member 120, from the first opening 30*b* into the first housing chamber 30*a* (FIG. 1, FIG. 4, FIG. 7, and FIG. 8). The connector fit portion 131 has an outer peripheral surface arranged in such a manner as to face an inner peripheral surface of the main body 31. An annular liquid sealing member 151 is provided between the inner peripheral surface of the main body 31 and the outer peripheral surface of the connector fit portion 131 (FIG. 1, FIG. 4, FIG. 7, and FIG. 8). The liquid sealing member 151 controls a flow of liquid (such as water) between the inner peripheral surface of the main body 31 and the outer peripheral surface of the connector fit portion 131 (specifically, intrusion of liquid from side of first opening 30*b*).

Moreover, this holding member 130 includes a housing portion 132 housed in a second housing chamber 140*a* (described later) of the second housing body 140 (FIG. 4 and FIG. 8). The housing portion 132 is arranged on a side in the connector removal direction of the connector fit portion 131.

The second housing body 140 includes the second housing chamber 140*a* that houses the holding member 130 (FIG. 1 and FIG. 8). The second housing chamber 140*a* houses the housing portion 132.

The second housing body 140 in this example includes two sealing members attached to each other (first sealing member 141 and second sealing member 142) (FIG. 4, FIG. 7, and FIG. 8). The first sealing member 141 and the second sealing member 142 are formed of a conductive material such as metal.

The first sealing member 141 includes a cylindrically-formed main body 141*a* with the connector insertion/removal direction as a cylinder axis direction (FIG. 4 and FIG. 8). In the second housing body 140, an internal space of the cylindrical main body 141*a* is used as the second housing chamber 140*a*. In the second housing chamber 140*a*, the housing portion 132 of the holding member 130 is housed with an annular gap with respect to an inner peripheral surface of the main body 141*a*.

The main body 141*a* has a first opening 141$a_1$ on a side in the connector insertion direction, and a second opening 141$a_2$ on a side in the connector removal direction (FIG. 4). In this example, the housing portion 132 of the holding member 130 is housed from the first opening 141$a_1$. Also, in this example, the electric wire WH pulled out from the holding member 130 is pulled out from the second opening 141$a_2$.

The first sealing member 141 is formed of a conductive material such as metal. For example, this first sealing member 141 is formed by press working such as cutting or bending with a metallic plate as a base material.

Here, the first sealing member 141 includes an annular flange portion 141*b* around a rim on a side of the first opening 141$a_1$ in the main body 141*a* (FIG. 4, FIG. 7, and FIG. 8).

Also, this first sealing member 141 is used to fix the second housing body 140 to the first housing body 30. The first sealing member 141 includes a fixing portion 141*c* used for the fixation (FIG. 1, FIG. 2, FIG. 4, FIG. 7, and FIG. 8). The fixing portion 141*c* in this example is formed as a plate-shaped piece protruded from the flange portion 141*b*. In this fixing portion 141*c*, a through hole 141$c_1$ with an axis being in a direction orthogonal to own plain surface is formed (FIG. 1, FIG. 7, and FIG. 8). For example, the first housing body 30 includes a boss portion 32 in which a female screw portion (not illustrated) is formed (FIG. 1 to FIG. 6). The fixing portion 141*c* is fixed to the boss portion 32 by screwing of a male screw member B, which is inserted into the through hole 141$c_1$, to the female screw portion of the boss portion 32. Here, two pairs of the fixing portion 141*c* and the boss portion 32 are provided.

The second sealing member 142 covers an outer peripheral surface of the main body 141*a* of the first sealing member 141, and covers the electric wire WH pulled out from the second opening 141$a_2$. The second sealing member 142 in this example is provided as a braid in which a conductive strand is woven cylindrically in a net-like manner. This second sealing member 142 is attached, with an annular conductive connecting member 143, to the outer peripheral surface of the main body 141*a* of the first sealing member 141 (FIG. 4, FIG. 7, and FIG. 8). The connecting member 143 is formed cylindrically, and electrically connects the first sealing member 141 and the second sealing member 142 by pushing, in the inside thereof, the second sealing member 142 to the outer peripheral surface of the main body 141*a*.

The cover 210 blocks the second opening 30*c* after the electric connection portions 21 and 121 of the first conductive member 20 and the second conductive member 120 are screwed. This cover 210 includes a cover main body 211 that blocks the second opening 30*c* (FIG. 1 to FIG. 4, FIG. 9, and FIG. 10). For example, the second opening 30*c* in this example is formed in an oval. The cover main body 211 is formed in an oval that matches the shape of the second opening 30*c*.

Figure 6:
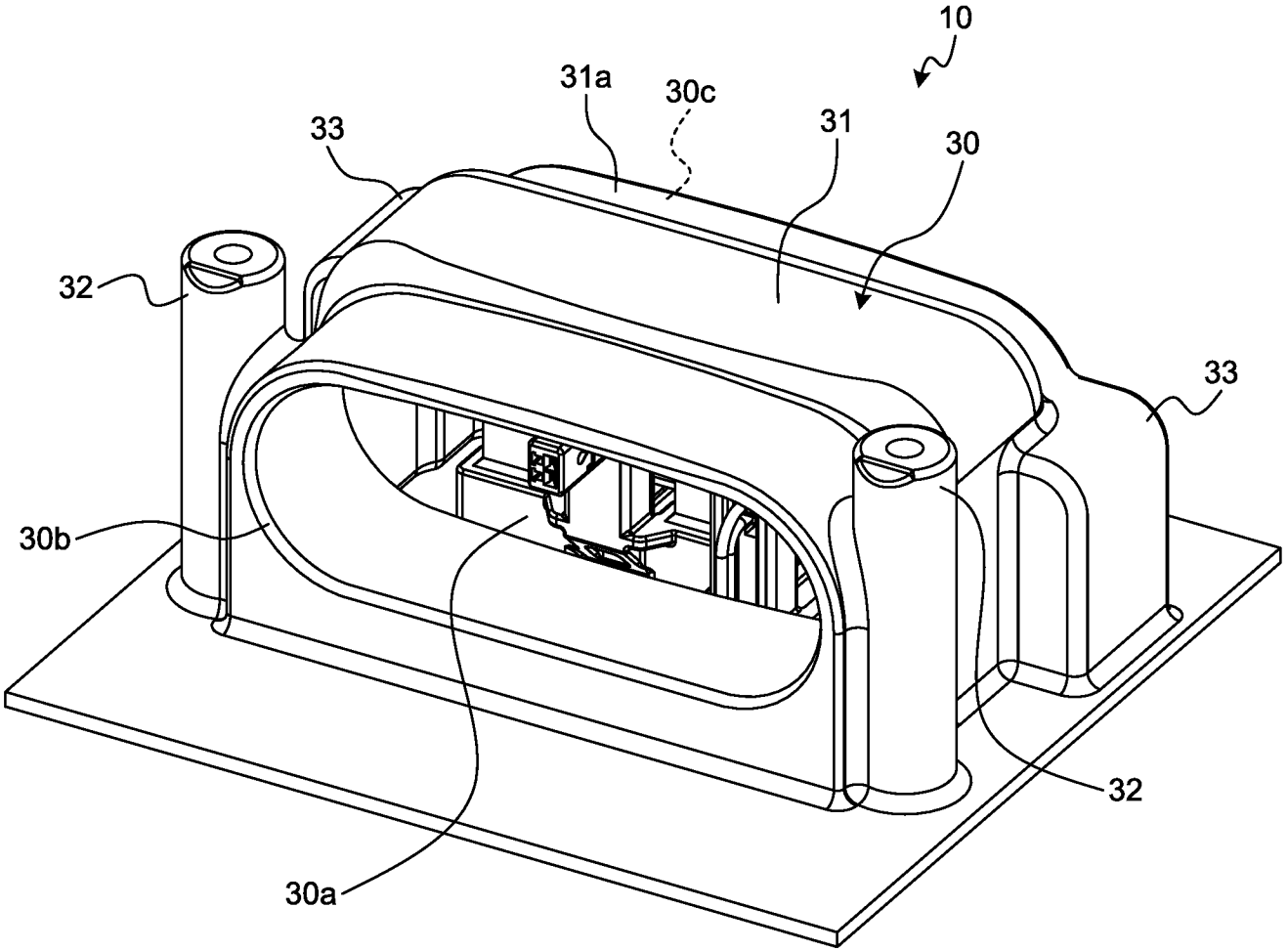
FIG. 6 is a perspective view in which the first connector is seen from a different angle.

In the main body 31 of the first housing body 30 in this example, a cylindrical portion 31*a* to which the cover main body 211 is fit is formed (FIG. 5 and FIG. 6). The cylindrical portion 31*a* has an oval second opening 30*c*, and an internal space 31$a_1$ with a cross-sectional surface orthogonal in the connector insertion/removal direction being a cross-sectional surface having the same shape with the second opening 30*c*. The cover main body 211 includes a fitting member 211*a* that is fit to the internal space 31$a_1$ (FIG. 4, and FIG. 9 to FIG. 12). The fitting member 211*a* is formed of an insulating material such as a synthetic resin, for example, as a columnar member in which a cross-sectional surface orthogonal in the connector insertion/removal direction is an oval, or a cylindrical member having an outer shape of this columnar member. This fitting member 211*a* is inserted into the internal space 31$a_1$ of the cylindrical portion 31*a* and is arranged in such a manner as to face an inner peripheral surface of this cylindrical portion 31*a* with an annular gap. An annular liquid sealing member 152 is provided between the inner peripheral surface of the cylindrical portion 31*a* and an outer peripheral surface of the fitting member 211*a* (FIG. 1 and FIG. 4). The liquid sealing member 152 controls a flow of liquid (such as water) between the inner peripheral surface of the cylindrical portion 31*a* and the outer peripheral surface of the fitting member 211*a* (specifically, intrusion of liquid from side of second opening 30*c*).

Figure 9:
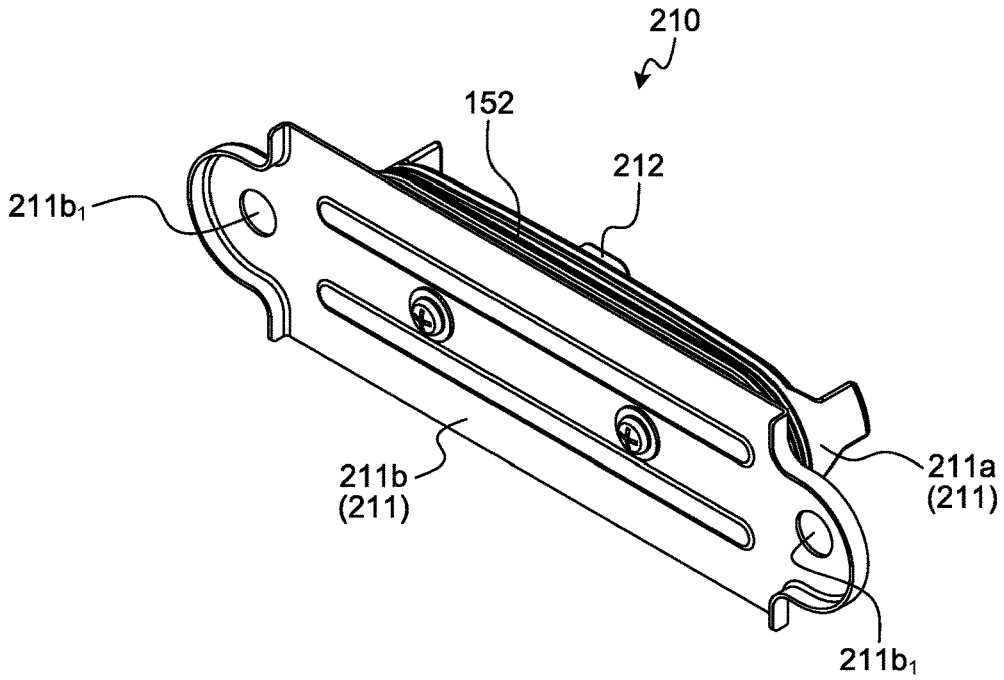
FIG. 9 is a perspective view illustrating the cover.
Figure 10:
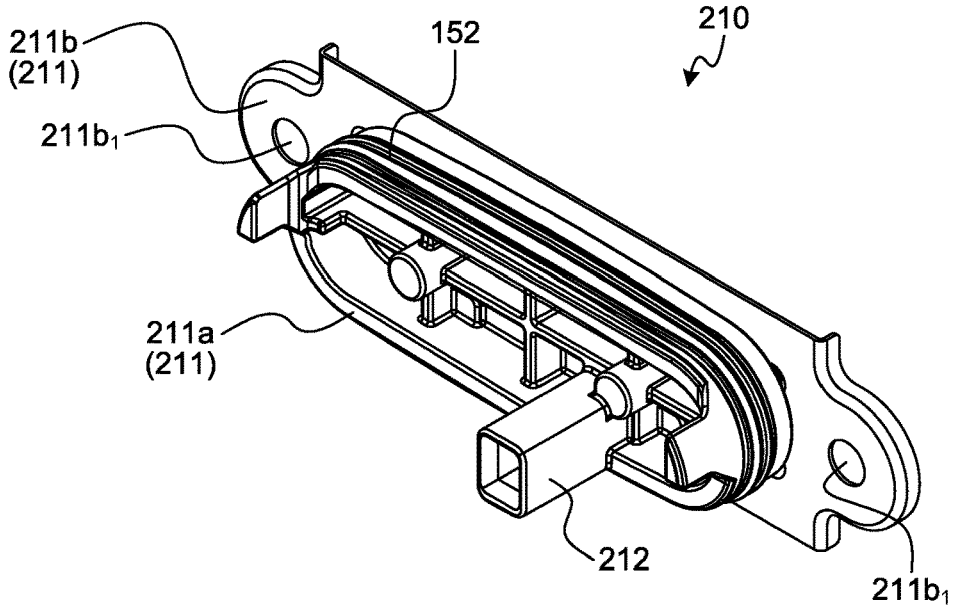
FIG. 10 is a perspective view in which the cover is seen from a different angle.

The cover main body 211 in this example includes a fixing member 211*b* for fixation to the first housing body 30 with the second opening 30*c* being in a blocked state (FIG. 4, and FIG. 9 to FIG. 12). The fixing member 211*b* is formed in an oval plate shape larger than the fitting member 211*a* and is fixed to a side in the connector insertion direction of this fitting member 211*a*. This fixation can be performed by any kind of method such as screwing. The fixing member 211*b* has a through hole 211$b_1$ with an axis being in a direction orthogonal to own plain surface (FIG. 1, FIG. 9, and FIG. 10). On the other hand, the first housing body 30 includes a boss portion 33 in which a female screw portion (not illustrated) is formed (FIG. 1, FIG. 2, FIG. 5, and FIG. 6). The fixing member 211*b* is fixed to the boss portion 33 by screwing of a male screw member B inserted into the through hole 211$b_1$ to the female screw portion of the boss portion 33. Here, two pairs of the through hole 211$b_1$ and the boss portion 33 are provided.

Here, in the cover main body 211, centers of the through holes 211$b_1$ are arranged at equal intervals when seen in a longitudinal direction from a central axis of the fitting member 211*a* (that is, center of oval forming outer shape of fitting member 211*a*). Thus, even when the cover main body 211 is rotated for 180 degrees around the central axis of the fitting member 211*a*, it is possible to insert the fitting member 211*a* into the internal space 31$a_1$ of the cylindrical portion 31*a* and to screw the fixing member 211*b* to each of the boss portions 33.

The cover 210 further includes a protruded body 212 that is protruded from the cover main body 211 and is arranged in the first housing chamber 30*a* when this cover main body 211 blocks the second opening 30*c* (FIG. 1, and FIG. 9 to FIG. 12). The protruded body 212 is arranged at an eccentric position with respect to the central axis of the fitting member 211*a*. In this example, a cubular protruded body 212 is protruded from an end on a side in the connector removal direction of the fitting member 211*a*.

The connector device 1 described here as an example forms an electric circuit, in which an energization circuit for each phase is provided, by connection of the first connector 10 and the second connector 110. Here, a three-phase AC circuit is formed as an electric circuit. In the connector device 1, a combination of the first conductive member 20 and the second conductive member 120 is provided for each phase of the electric circuit.

Incidentally, this connector device 1 can keep an energization circuit, which is formed by the first conductive member 20 and the second conductive member 120, in an energized state and also can keep the energization circuit in a broken state. The energized state is a state in which the electric connection portions 21 and 121 of the first conductive member 20 and the second conductive member 120 are overlapped with each other, and is a state in which the electric connection portions 21 and 121 can be screwed. The broken state is a state in which the electric connection portions 21 and 121 are not in contact with each other. The broken state is necessary, for example, for a case where an electric device that is electrically connected to a power side via this connector device 1 is checked up. In this connector device 1, the second housing chamber 140*a*, the cover 210, and the holding member 130 are configured in a manner described in the following in such a manner that the energized state and the broken state are arbitrarily selected and kept.

Figure 11:
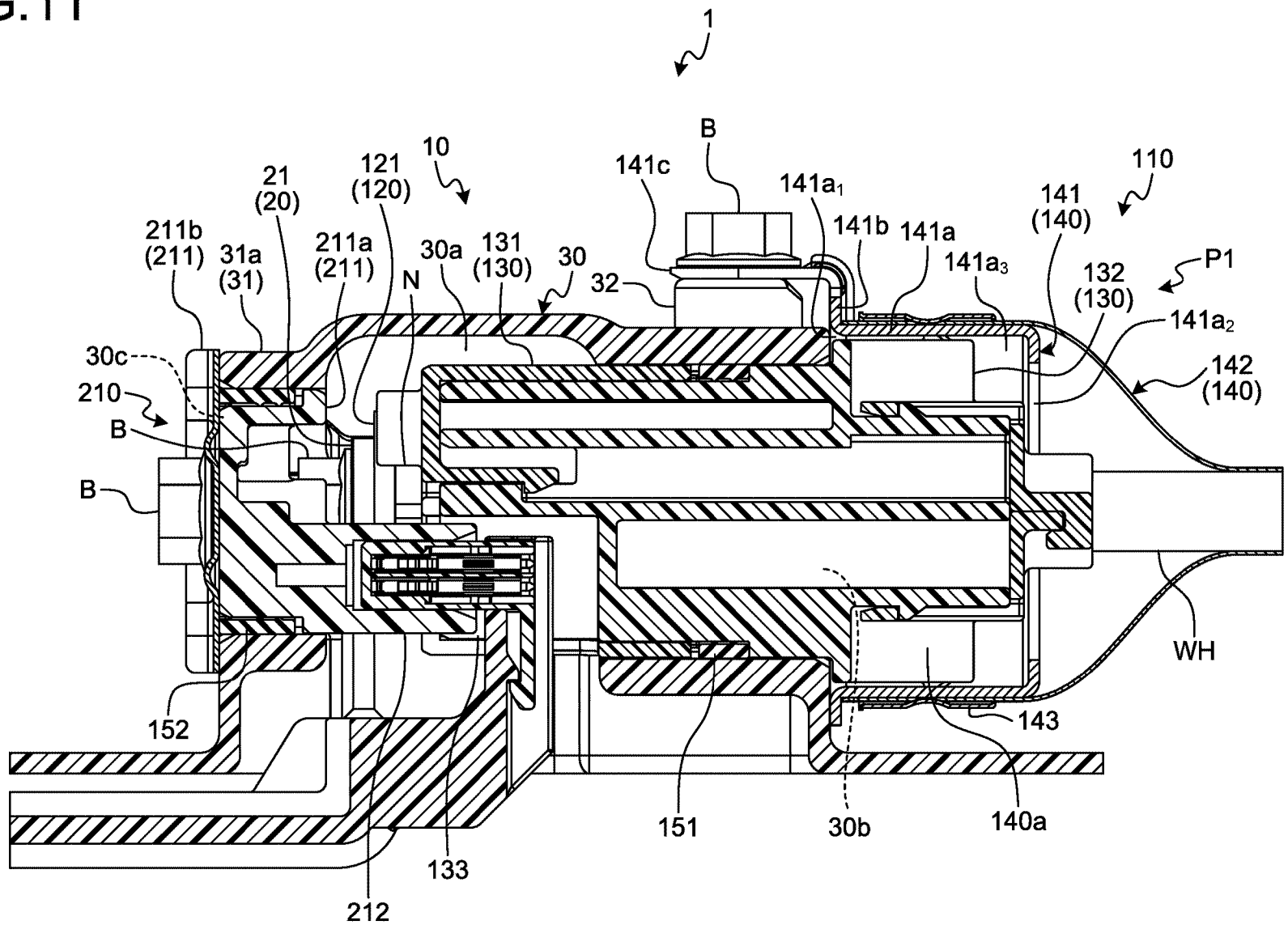
FIG. 11 is an X2-X2 sectional view of FIG. 3 and is a view illustrating a case where the cover is in the first attachment state.
Figure 12:
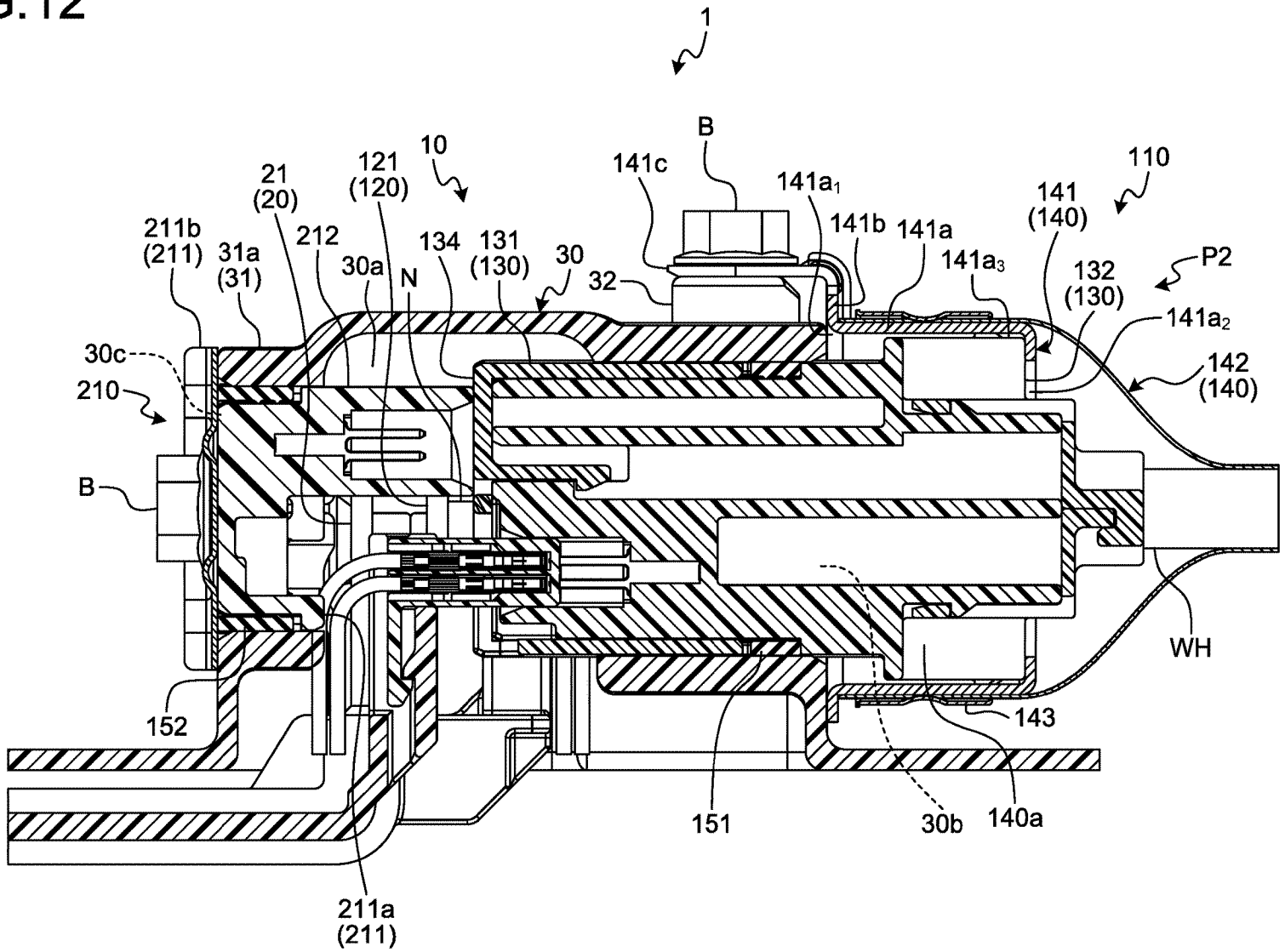
FIG. 12 is an X3-X3 sectional view of FIG. 3 and is a view illustrating a case where the cover is in the second attachment state.

The second housing chamber 140*a* is formed in such a manner as to have a housed position P1 of the holding member 130 of when the energization circuit is in the energized state (hereinafter, referred to as "first housed position") (FIG. 4 and FIG. 11), and a housed position P2 of the holding member 130 of when the energization circuit is in the broken state (hereinafter, referred to as "second housed position") (FIG. 12).

More specifically, the first housed position P1 is a housed position of the housing portion 132 in the second housing chamber 140*a* in the energized state, that is, a housed position of the housing portion 132 in the second housing chamber 140*a* of when the electric connection portions 21 and 121 can be screwed. In the second housing chamber 140*a*, a space 141$a_3$ is provided on a side in the connector removal direction of the housing portion 132 at the first housed position P1 (FIG. 4, FIG. 11, and FIG. 12). The space 141$a_3$ is formed in a shape and a size into which the housing portion 132 at the first housed position P1 can be inserted. Thus, the housing portion 132 pushed in the connector removal direction at the first housed position P1 can be inserted into the space 141$a_3$ when the electric connection portions 21 and 121 are not screwed. In the connector device 1, the electric connection portions 21 and 121 are not electrically connected and the energization circuit is in the broken state when the housing portion 132 is in the space 141$a_3$. Thus, more specifically, the second housed position P2 in this example is a housed position of when the housing portion 132 is in the space 141$a_3$. As described, the second housing chamber 140*a* is formed in such a manner that the housing portion 132 can be moved in the inside thereof relatively in the connector insertion/removal direction between the first housed position P1 and the second housed position P2. Note that in this example, a part of the housing portion 132 at the second housed position P2 is extended in the connector removal direction from the second opening 141$a_2$ of the main body 141*a*.

The cover 210 is formed in a manner attachable, in at least two different attachment states, to the second opening 30*c* of the first housing body 30. As described above, this cover 210 can be rotated for 180 degrees around the central axis of the fitting member 211*a* and attached to the first housing body 30. Here, one attachment state is referred to as a first attachment state, and the other attachment state is referred to as a second attachment state. In the cover 210, it is possible to block the second opening 30*c* with the cover main body 211 and to arrange the protruded body 212 in the first housing chamber 30*a* in both of the first attachment state and the second attachment state. However, in the cover 210, an arrangement of the protruded body 212 in the first housing chamber 30*a* varies between the first attachment state and the second attachment state.

In the holding member 130, a non-contact portion 133 that does not come into contact with the protruded body 212 regardless of own housed position in the second housing chamber 140*a* in a case where the cover 210 is in the first attachment state is provided (FIG. 1, FIG. 7, FIG. 8, and FIG. 11). Since not being in contact with the protruded body 212 when the cover 210 is in the first attachment state, the holding member 130 can keep own housed position in the second housing chamber 140*a* at an original position. For example, in the connector device 1, in a case where the holding member 130 (housing portion 132) is housed at the first housed position P1 in the second housing chamber 140*a* and the cover 210 is attached in the first attachment state, it is possible to keep the energization circuit in the energized state. For example, the non-contact portion 133 is formed as a housing portion into which the protruded body 212 is housed in a non-contact manner when the cover 210 is in the first attachment state, or as an insertion portion, such as a groove or a notch, into which the protruded body 212 is inserted in a non-contact manner when the cover 210 is in the first attachment state. Here, the non-contact portion 133 is formed as an insertion portion. Note that the housing portion or the insertion portion can come into contact with the protruded body 212 as long as a load is not applied from the protruded body 212 to the holding member 130 in consideration of a tolerance variation or an attachment variation of a component.

Also, in this holding member 130, a pushed portion 134 that is pushed by the protruded body 212 until own housed position in the second housing chamber 140*a* becomes the second housed position P2 in a case where the own housed position in the second housing chamber 140*a* is the first housed position P1 and the cover 210 is attached to the second opening 30*c* in the second attachment state is provided (FIG. 1, FIG. 7, FIG. 8, and FIG. 12). When the cover 210 is attached in the second attachment state to the second opening 30*c* in a case where the housed position of the holding member 130 (housing portion 132) in the second housing chamber 140*a* is the first housed position P1, a leading end of the protruded body 212 comes into contact with the pushed portion 134. In a case where the electric connection portions 21 and 121 are not screwed, the holding member 130 is pushed and moved in the connector removal direction by the protruded body 212 when operation of attaching the cover 210 is kept performed. When attachment of the cover 210 in the second attachment state is completed, the housed position of the holding member 130 in the second housing chamber 140*a* becomes the second housed position P2. In a case where the holding member 130 (housing portion 132) is housed at the second housed position P2 in the second housing chamber 140*a*, the energization circuit becomes the broken state in the connector device 1. In this connector device 1, since the cover 210 is attached in the second attachment state to the second opening 30*c*, it is possible to keep the energization circuit in the broken state.

In this example, the non-contact portion 133 and the pushed portion 134 are provided in the connector fit portion 131.

As described, in the connector device 1 of the present embodiment, it is possible to keep an energization circuit, which is formed by the first conductive member 20 and the second conductive member 120, in an energized state and to keep the energization circuit in a broken state. Also, in this connector device 1, the cover 210 is attached in the first attachment state to the second opening 30*c* when the energization circuit is in the energized state. Thus, it is possible to control intrusion of liquid (such as water) or dust from the second opening 30*c*. In addition, in this connector device 1, a connection part between the first conductive member 20 and the second conductive member 120 can be hidden from the outside in such a manner as not to be touched by the other components or a human. Moreover, in this connector device 1, the cover 210 is attached in the second attachment state to the second opening 30*c* when the energization circuit is in the broken state. Thus, in this case, it is also possible to control intrusion of liquid (such as water) or dust from the second opening 30*c*. Also, in this connector device 1, when the energization circuit is in the broken state, the connection part between the first conductive member 20 and the second conductive member 120 can be also hidden from the outside in such a manner as not to be touched by the other components or a human. As described above, in the connector device 1 of the present embodiment, it is possible to improve durability and safety when the energization circuit is in both of the energized state and the broken state. Also, in this connector device 1, without being conscious of durability or safety thereof, it is possible to connect or break the energization circuit only by a simple structure of changing an attachment state of the cover 210.

In a connector device according to the present embodiment, it is possible to keep an energization circuit, which is formed by a first conductive member and a second conductive member, in an energized state and to keep the energization circuit in a broken state. Also, in this connector device, a cover is attached in a first attachment state to a second opening when the energization circuit is in the energized state. Thus, it is possible to control intrusion of liquid (such as water) or dust from the second opening. In addition, in this connector device, a connection part between the first conductive member and the second conductive member can be hidden from the outside in such a manner as not to be touched by the other components or a human. Moreover, in this connector device, a cover is attached in a second attachment state to the second opening when the energization circuit is in the broken state. Thus, it is also possible in this case to control intrusion of liquid (such as water) or dust from the second opening. Also, in this connector device, when the energization circuit is in the broken state, the connection part between the first conductive member and the second conductive member can be also hidden from the outside in such a manner as not to be touched by the other components or a human. As described above, when the energization circuit is in both of the energized state and the broken state, it is possible to improve durability and safety in the connector device according to the present invention. Also, in this connector device, without being conscious of durability and safety thereof, it is possible to connect and break the energization circuit only by a simple structure of changing an attachment state of a cover.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connector device comprising:

a first connector that includes a first conductive member, and a first housing body including a first housing chamber in which the first conductive member is housed, and a first opening and a second opening that are arranged in a connector insertion/removal direction and that communicate with the first housing chamber;

a second connector that includes a second conductive member inserted into the first housing chamber from the first opening and physically and electrically connected to the first conductive member, a holding member that holds the second conductive member, and a second housing body including a second housing chamber in which the holding member is housed; and a cover that includes a cover main body that blocks the second opening, and a protruded body that is protruded from the cover main body and is arranged in the first housing chamber when the cover main body blocks the second opening, wherein the second housing chamber has a first housed position of the holding member of when an energization circuit formed by the first conductive member and the second conductive member is in an energized state, and a second housed position of the holding member of when the energization circuit is in a state in which the first conductive member and the second conductive member are electrically disengaged from each other, the cover can be attached to the second opening in a first attachment state in which the second opening is blocked by the cover main body and the protruded body is arranged in the first housing chamber in a first orientation relative to the holding member, or a second attachment state which is an attachment state different from the first attachment state and in which the second opening is blocked by the cover main body and the protruded body is arranged in the first housing chamber in a second orientation relative to the holding member that is different than the first orientation, and the holding member includes a non-contact portion that does not come into contact with the protruded body regardless of a housed position of the holding member in the second housing chamber in a case where the cover is in the first attachment state, and a pushed portion pushed by the protruded body until the housed position of the holding member in the second housing chamber becomes the second housed position in a case where the housed position of the holding member in the second housing chamber is the first housed position and the cover is attached in the second attachment state to the second opening.

2. The connector device according to claim 1, wherein the holding member includes a connector fit portion that is inserted, along with the second conductive member, into the first housing chamber from the first opening, and the connector fit portion includes the non-contact portion and the pushed portion.

3. The connector device according to claim 1, wherein the non-contact portion is a housing portion in which the protruded body is housed when the cover is in the first attachment state, or an insertion portion into which the protruded body is inserted when the cover is in the first attachment state.

4. The connector device according to claim 2, wherein the non-contact portion is a housing portion in which the protruded body is housed when the cover is in the first attachment state, or an insertion portion into which the protruded body is inserted when the cover is in the first attachment state.

5. The connector device according to claim 1, wherein a combination of the first conductive member and the second conductive member is provided for each phase of an electric circuit.

6. The connector device according to claim 2, wherein a combination of the first conductive member and the second conductive member is provided for each phase of an electric circuit.

7. The connector device according to claim 3, wherein a combination of the first conductive member and the second conductive member is provided for each phase of an electric circuit.

8. The connector device according to claim 4, wherein a combination of the first conductive member and the second conductive member is provided for each phase of an electric circuit.

* * * * *